US011149387B2

(12) United States Patent
Kitano

(10) Patent No.: US 11,149,387 B2
(45) Date of Patent: Oct. 19, 2021

(54) DECK-SLAB WATERPROOFING-MEMBRANE APPLICATION BRUSH AND DECK-SLAB WATERPROOFING-MEMBRANE APPLICATION APPARATUS PROVIDED THEREWITH

(71) Applicant: MK Build Co., Ltd., Hyogo (JP)

(72) Inventor: Masao Kitano, Kobe (JP)

(73) Assignee: MK Build Co., Ltd., Kobe (JP)

( * ) Notice: Subject to any disclaimer, the term of this patent is extended or adjusted under 35 U.S.C. 154(b) by 53 days.

(21) Appl. No.: 16/691,634

(22) Filed: Nov. 22, 2019

(65) Prior Publication Data

US 2020/0283967 A1 Sep. 10, 2020

(30) Foreign Application Priority Data

Mar. 5, 2019 (JP) ..... JP2019-039391

(51) Int. Cl.
*E01C 19/45* (2006.01)
*E01C 19/17* (2006.01)

(52) U.S. Cl.
CPC ..... *E01C 19/178* (2013.01); *E01C 19/45* (2013.01)

(58) Field of Classification Search
CPC ..... E01C 19/45; E01C 19/178
USPC ..... 404/101–111, 82
See application file for complete search history.

(56) References Cited

U.S. PATENT DOCUMENTS 1,702,666 A * 2/1929 Nickerson ..... E01C 19/482 404/103
1,885,319 A * 11/1932 Baumgardner ..... E01C 19/202 222/313
2,962,946 A * 12/1960 Neff ..... E01H 1/02 404/101
3,055,280 A * 9/1962 Neville ..... E01C 19/488 404/95
3,989,403 A * 11/1976 Verive ..... E01C 19/16 404/111
4,789,265 A * 12/1988 Wilson ..... E01C 11/005 118/108
4,831,958 A * 5/1989 Selby ..... E01C 23/0973 118/108

(Continued)

FOREIGN PATENT DOCUMENTS

JP 3024935 U 6/1996
JP 1998-018216 A 1/1998

(Continued)

*Primary Examiner* — Raymond W Addie
(74) *Attorney, Agent, or Firm* — J-Pat U.S. Patent Legal Services; James Judge

(57) ABSTRACT

A deck-slab waterproofing-membrane application brush for coating highway-bridge deck slabs with a waterproofing membrane, and a deck-slab waterproofing-membrane application apparatus for towing the brush to spread on waterproofing product are made available to enable the applying of deck-slab waterproofing membranes uniformly, safely, and efficiently to highway bridges. The deck-slab waterproofing-membrane application brush, for spreading on highway-bridge deck-slab waterproofing product, is characterized in that inside a furrow in a furrowed metal plate, numerous metallic bristles are aligned into rows in a packed, sheet-like form and fastened in a state in which the numerous metallic bristles are clamped.

6 Claims, 5 Drawing Sheets

(56) References Cited

U.S. PATENT DOCUMENTS

| | | | | | |
|---|---|---|---|---|---|
| 4,917,533 | A * | 4/1990 | Wilson | E01C 11/005 | 118/108 |
| 5,362,178 | A * | 11/1994 | Schantz | E01C 19/16 | 222/167 |
| 5,735,952 | A * | 4/1998 | Wilson, Sr. | E01C 19/16 | 118/100 |
| 7,033,106 | B2 * | 4/2006 | Harvey | E01C 23/098 | 404/107 |
| 8,113,736 | B2 * | 2/2012 | Wilson, Sr. | E01C 19/21 | 404/72 |
| 2007/0104537 | A1 * | 5/2007 | Becker | E01C 19/17 | 404/75 |
| 2008/0224528 | A1 * | 9/2008 | Wang | A46D 3/00 | 300/21 |
| 2016/0145814 | A1 * | 5/2016 | Dwegerser | E01C 19/2045 | 404/110 |
| 2016/0221027 | A1 * | 8/2016 | Khan | A46B 7/046 | |
| 2018/0264511 | A1 * | 9/2018 | Wadkins | E01C 19/4866 | |

FOREIGN PATENT DOCUMENTS

| | | | |
|---|---|---|---|
| JP | 2006-266000 | A | 10/2006 |
| JP | 2009-167605 | A | 7/2009 |

* cited by examiner

DECK-SLAB WATERPROOFING-MEMBRANE APPLICATION BRUSH AND DECK-SLAB WATERPROOFING-MEMBRANE APPLICATION APPARATUS PROVIDED THEREWITH

BACKGROUND OF THE INVENTION

Technical Field

The present invention relates to deck-slab waterproofing-membrane application brushes for coating highway-bridge deck slabs with a waterproofing membrane, and to a deck-slab waterproofing-membrane application apparatus for towing an application brush.

Description of the Related Art

When paving onto highway-bridge deck slabs is carried out, in advance of the paving, a waterproofing layer is built onto the deck slabs, then paving is implemented. The deck-slab waterproofing product ordinarily is heat-liquefied at 180 to 220° C. and evenly applied to the deck-slab section at a thickness of 1 mm to 5 mm, protecting against rainwater or other moisture infiltrating into the deck-slab section though it encroaches toward the deck-slab section through the asphalt pavement; wherein it is necessary for the application job to be done safely, rapidly, and uniformly.

To date, the paving work has been carried out by drawing the material (melting temperature 200° C.) out from the melting kettle into a metal bucket or the like, and, by a manual operation, conveying it to the application location. But with the rubber rakes and brushes that have been employed to date, applying the material uniformly onto the roughness of a deck-slab section has not been possible. What is more, because the molten material clings to rubber rakes and brushes and hardens, frequent replacement work has been necessary.

As apparatuses that pour the asphalt product, various inventions and conceptions have been proposed.

Proposed in Japanese Unexamined Pat. App. Pub. No. H10-18216 is one where an asphalt mixer is loaded onto the bed of a truck that can be run on public roads, with the asphalt mixer being a device furnished with an aggregate supplying means, a filler supplying means, an asphalt supplying means, a mixer, and a heating means for supplying heat to the asphalt supply means and the mixer.

Proposed in Japanese Registered Utility Model No. 3024935 is an asphalt-product pouring apparatus carrying onboard: a liquefying kettle holding asphalt product in a molten state, on a carrier that comprises a three-wheeled hand truck and is designed so that a worker can move it by his or her own strength; a gear pump installed inside the liquefying kettle, for expelling asphalt pitch that is in a molten state to the exterior; an expel hose having a nozzle on a tip end thereof, and being for pouring into a predetermined location the molten asphalt pitch expelled from the gear pump; a power transmission device for driving the gear pump, and comprising a driveshaft, a sprocket, a chain, and a speed reducer; an engine for driving the power transmission device; a heating device for heating the environs of the liquefying kettle, and made up of a burner and a gas canister; and a washing device for clearing residual asphalt pitch out of the expel hose interior.

Also, proposed in Japanese Unexamined Pat. App. Pub. No. 2006-266000 is an apparatus furnished with a power transmission device designed to enable switching the rotational motion of the gear pump between forward rotation and reverse rotation, and rendered to enable casting of asphalt pitch into the liquefying kettle to be carried out without manual intervention.

Still further, proposed in Japanese Unexamined Pat. App. Pub. No. 2009-167605 is an apparatus made up of an outer kettle that is equipped with a conveyance means, and an open-topped inner kettle that can be freely placed into and taken out of an inner-kettle placement space that constitutes the inside of the outer kettle, and that is provided, in the outer-kettle lower portion, with a combustion chamber furnished with sidewall openings for inserting heating means and, in the combustion chamber, with a carrying member for supporting the inner kettle as well as with a convection-current shielding means.

Nevertheless, the apparatus involving Japanese Unexamined Pat. App. Pub. No. H10-18216 is large-sized equipment, and small-scale mending such as repairs of cracks and splits is, from both a cost aspect and a transport aspect, challenging to put into practice. While the apparatus involving Japanese Registered Utility Model No. 3024935 is small-sized equipment that employs the discharge gas from the engine to discharge the residual asphalt, its structure is complex. A problem with the apparatus involving Japanese Unexamined Pat. App. Pub. No. 2006-266000 is that because the rotational motion of the gear pump switches between the forward direction and the reverse direction, ultimately the structure is complex. Furthermore, although the structure of the apparatus involving Japanese Unexamined Pat. App. Pub. No. 2009-167605 is simple, there have been problems with its means for applying asphalt in a molten state onto roads.

BRIEF SUMMARY OF INVENTION

An issue for the present invention, in order to solve drawbacks such as the foregoing of the conventional technology, is to make available a deck-slab waterproofing-membrane application brush for coating highway-bridge deck slabs with a waterproofing membrane, and a deck-slab waterproofing-membrane application apparatus for towing the application brush to spread on waterproofing product, to enable the applying of deck-slab waterproofing membranes uniformly, safely, and efficiently to highway bridges.

The present invention, in order to resolve the just-stated issue, is a deck-slab waterproofing-membrane application brush for spreading waterproofing product onto highway-bridge deck-slabs, characterized in that inside a furrow in a furrowed metal plate, numerous metallic bristles are aligned into rows in a packed, sheet-like form and fastened in a state in which the numerous metallic bristles are clamped. Here, the numerous metallic bristles are advantageously weld-fastened inside the furrow in the furrowed metal plate and the lips of the furrowed metal plate are crimped onto them. Furthermore, having the furrowed metal plate be of a form in which it has been bent into a squared-U or a C shape makes it possible to carry out asphalt paving smoothly.

The present invention is an apparatus for spreading waterproofing membranes onto highway-bridge deck-slabs, furnished with: a hand truck designed to be mobile by being fitted with a handle and wheels; a liquefying kettle, carried on board the hand truck, for holding asphalt in a liquefied state; and a heating means carried on board the hand truck and, with propane gas being its fuel supply source, for heating the liquefying kettle; characterized in that the highway-bridge deck-slab waterproofing-membrane application apparatus, towing the abovesaid deck-slab waterproofing-membrane application brush, spreads on asphalt discharged from the liquefying kettle, a deck-slab waterproofing product. It is characterized in being furnished with a cowl housing the liquifying kettle, and a camera, disposed in a desired position on the cowl, for filming the status of the application of the deck-slab waterproofing product, and furthermore is provided with a video monitor on the handle, for monitoring the application status.

Utilizing a deck-slab waterproofing-membrane application brush and a deck-slab waterproofing-membrane application apparatus for towing the application brush that involve the present invention enables the applying of deck-slab waterproofing membranes uniformly, safely, and efficiently to highway bridges.

Because an application brush involving the present invention employs a metal brush (stainless steel, brass, or the like), work can be carried out continuously while warmth is easily maintained with the burner, etc. What is more, a deck-slab waterproofing-membrane application apparatus involving the present invention enables spreading on to a maximum of 150 $m^2$ with a one-time pouring, since an application machine carrying on board a warming kettle (30 to 300 l) makes pouring from the melting kettle into the warming kettle possible. Since whether a deck-slab section is being coated uniformly can be checked by means of the camera and the television monitor while checking on the application work, the capacity for applying a deck-slab waterproofing membrane may be improved by a wide margin. Having the onboard-carrying hand truck run on batteries diminishes noise and vibrations, such that work can be carried out without problems even during the night.

Further still, the time and labor of transporting buckets can be saved, and the occurrence to workers of troubles such as burns is lessened, securing safety.

BRIEF DESCRIPTION OF THE SEVERAL VIEWS OF THE DRAWINGS

FIGS. 5A and 5B are diagrams illustrating an instance of employing a deck-slab waterproofing-membrane application apparatus 1 involving Embodiment Example 1, wherein FIG. 5A depicts molten asphalt being dropped over a paving line, and FIG. 5B depicts the deck-slab waterproofing-membrane application apparatus being drawn backward to tow the application brush and level out the molten asphalt.

DETAILED DESCRIPTION OF THE INVENTION

Figure 1:
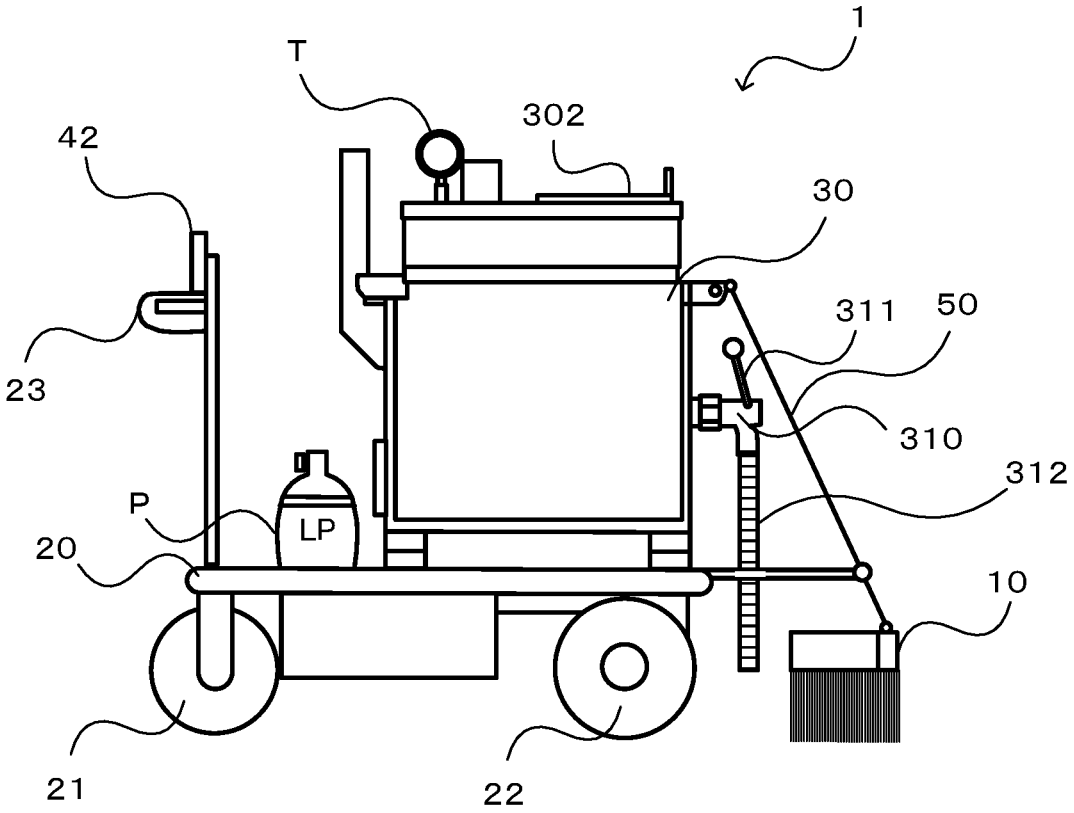
FIG. 1 is a left-side view of a deck-slab waterproofing-membrane application apparatus involving the present invention.

In the following, based on the drawings, a detailed description of embodiment examples of the present invention will be made. In each figure, identical parts are labeled with identical reference numbers, such that reduplicating description will be omitted. Further, the drawings in some instances are expressed exaggeratedly for the sake of understanding the present invention, wherein it should be borne in mind that they are not necessarily scaled-down, minute representations. Also, the present invention is not limited to the embodiment examples illustrated by the writing below.

Embodiment Example 1

Referring to the drawings, a detailed description of Embodiment Example 1 will be made.

Figure 2:
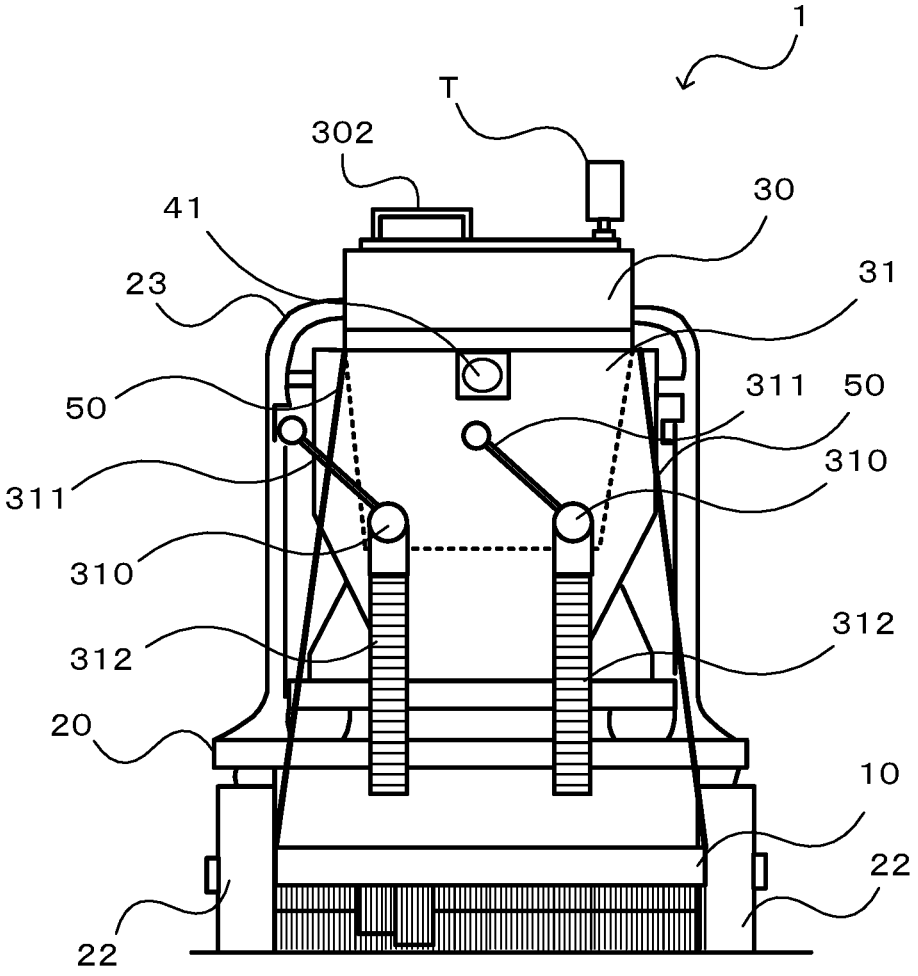
FIG. 2 is a front elevational view of the deck-slab waterproofing-membrane application apparatus involving the present invention.

Reference is made to FIGS. 1 and 2. FIG. 1 is a left-side view of a deck-slab waterproofing-membrane application apparatus 1 involving the present invention. FIG. 2 is a front elevational view of the deck-slab waterproofing-membrane application apparatus 1 involving the present invention.

As represented in FIGS. 1 and 2, the deck-slab waterproofing-membrane application apparatus 1, broadly outlined, is furnished with: a hand truck 20 designed to be mobile by being fitted with a handle 42 and, as vehicular wheels, rear wheels 21 and front wheels 22; a case 30, carried on board the hand truck 20, with a built-in liquefying kettle 31 for holding asphalt in a liquefied state; and a heating means (propane gas canister) P, likewise carried on board the hand truck 20, and, with propane gas being its fuel supply source, for heating the liquefying kettle 31; wherein asphalt discharged from the liquefying kettle 31 through asphalt discharge ports 310 via flexible stainless-steel hoses 312, by the operating of asphalt-discharge port open/close levers 311, is paved onto a road by a deck-slab waterproofing-membrane application brush 10 (hereinafter referred to simply as "application brush") being towed by towing pieces 50 to spread on the asphalt. Here, it should be borne in mind that the deck-slab waterproofing-membrane application apparatus 1 in FIG. 1 is pulled along backwards by a user gripping a handle 42, meanwhile towing the application brush 10, so that the front-rear positional relationships indicated in the present specification are that the application brush 10 side is the front and the handle 42 side is the rear. It should be noted that the towing pieces 50 may be constituted by components such as in the form of rods, pipes, plates, or ropes, and utilized with their opposite ends anchored to the case 30 and the application brush 10, respectively. Metals such as iron or stainless steel, or a fireproof plastic, can be used as the material for the towing pieces 50, although it is not particularly limited.

The case 30 in FIG. 2 is furnished with a liquefying kettle 31 (indicated by dotted lines) with an intervening heating/supporting unit (not illustrated) that is heated with a burner built into its interior. The liquifying kettle 31 is, as stated earlier, built into the case 30, with an upper lid 302 on the case 30 being open/closeable, wherein opening the upper lid 302 enables asphalt to be cast into the liquifying kettle 31. It should be noted that advantageously a temperature gauge T is provided in the vicinity of the upper lid 302, for measuring the temperature of the melted asphalt inside the liquefying kettle 31.

The case 30 is provided along its front side with the asphalt discharge ports 310 in the liquifying kettle 31, and the flexible stainless-steel hoses 312 are connected to the asphalt discharge ports 310, wherein opening/closing the asphalt discharge ports 310 by operating the asphalt-discharge port open/close levers 311 makes it possible to adjust the quantity of molten asphalt A expelled.

The capacity of the liquifying kettle 31 preferably is 30 to 300 €. Having it be this capacity enables spreading on to a maximum of 150 $m^2$ with a one-time pouring, saves the time and labor of transporting buckets, and lessens the occurrence to workers of troubles such as burns, securing safety.

The hand truck 20 is provided with, as handles 23, thill sections for towing, and having the hand truck run on batteries is preferable since noise and vibrations are nil, such that work can be carried out without problems even during the night. Also, the hand truck is advantageously configured with a monitor 42 attached to the handle 23, to allow a worker to check images shot with a later-described camera 41 attached to the front side of the case 30.

Further, as indicated in FIG. 2, the case 30 advantageously is furnished with a digital camera 41 and configured so that the status of the molten asphalt A being expelled, and the appearance of the asphalting by the later-described application brush 10 are filmed. The images shot with the digital camera 41 are transmitted to the monitor 42 attached to the handle 23, and while viewing the pictures imaged on the monitor 42, a worker can check the status of the molten asphalt A being expelled and the appearance of the asphalting by the later-described application brush 10. Since application work while checking, by means of the camera and the television monitor, whether a deck-slab section has been coated uniformly can be carried out, the capacity for coating a deck slab with a waterproofing membrane may be improved by a wide margin.

Figure 3:
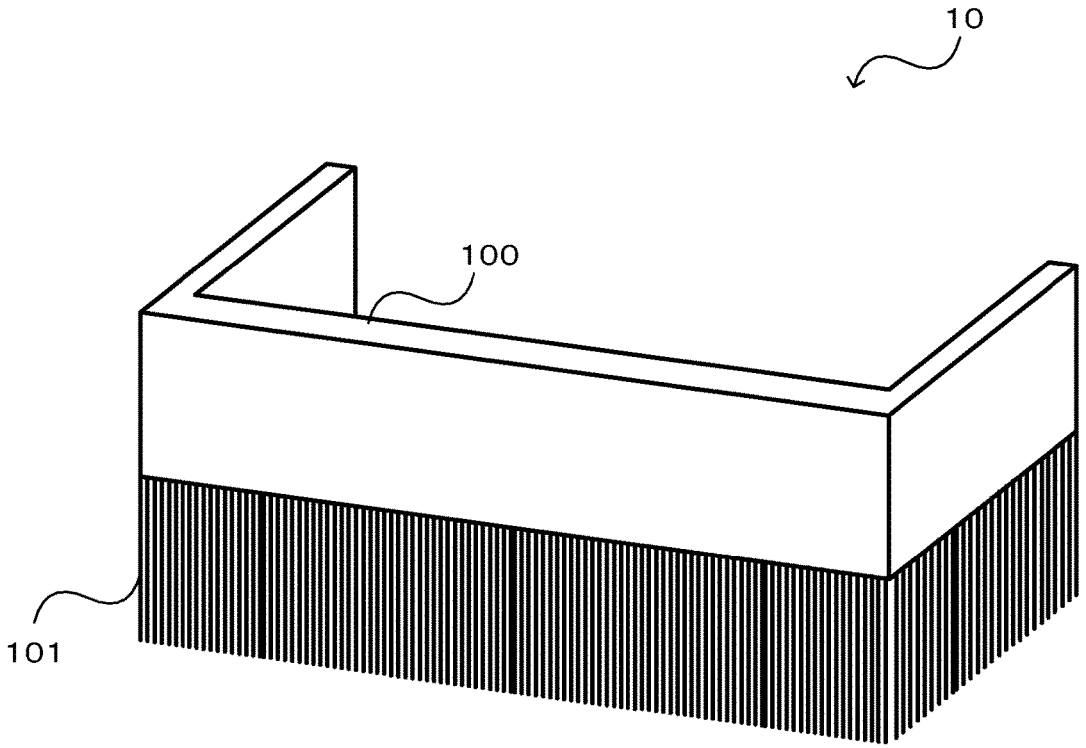
FIG. 3 is diagram illustrating a deck-slab waterproofing-membrane application brush involving the present invention.
Figure 4:
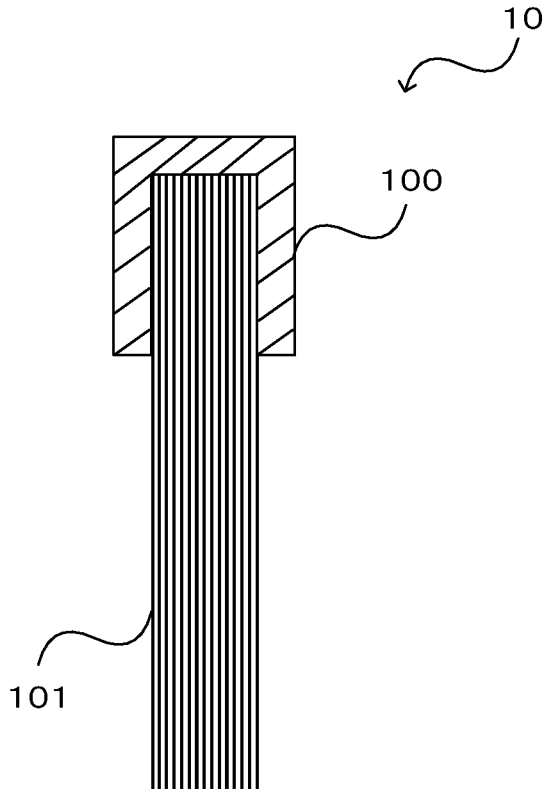
FIG. 4 is a cross-sectional diagram illustrating, with regard to a deck-slab waterproofing-membrane application brush involving the present invention, a state in which bristles 101 have been seated into a furrowed metal plate.

Reference is made to FIGS. 3 and 4. FIG. 3 is diagram illustrating an application brush 10, while FIG. 4 is a cross-sectional diagram illustrating a state in which bristles 101 have been seated into a furrowed metal plate 100.

As for the application brush 10, as indicated in FIGS. 3 and 4, inside a furrow in a furrowed metal plate 101, numerous metallic bristles 101 are aligned into rows in a packed, sheet-like form and fastened in a state in which the numerous metallic bristles 101 are clamped. Here, the numerous metallic bristles 101 are advantageously weld-fastened inside the furrow in the furrowed metal plate 100 and the lips of the furrowed metal plate are crimped onto them. Also, while the furrowed metal plate 100 in FIG. 3 assumes a squared-U form, it may also be of a form in which it has been bent into a C shape. The plate being of a form in which it has been bent into a squared-U or C shape can prevent asphalt from crossing out of the intended location where application is desired, so that asphalt paving can be carried out smoothly.

The metallic bristles 101 as illustrated in FIG. 4 are as a bundle set into and encased by a furrowed metal plate—that is, a squarish boxlike channel—made of stainless steel, and the bundle is weld-fastened inside the box.

Using stainless steel, brass, or the like for the metallic bristles 101 of the application brush 10 is preferable. Because they are made of metal, work can be carried out with ease continuously while warmth is maintained with the burner, etc.

Concerning the application brush 10 in Embodiment Example 1, the inventor, through various experiments and prototypes, concluded that in order to apply sealing material (asphalt) to a road surface at 1 to 10 mm smoothly as well as uniformly, a structure for the application brush 10 possessing the following conditions is optimal.

To begin with, as to the furrowed metal plate 100 the dimensions of the channel are important. According to word from manufacturers, from 3-gauge channels to 5-gauge channels are what are ordinarily employed, and fabricating with anything other than these is unworkable. Thus, what is preferable for the dimensions of the furrow in the metal plate is a rectangular form of 20 mm height and 100 mm width, but this is not necessarily limiting. For the channel thickness, 2 to 10 mm is preferable.

Next, as to the bristles 101, it is preferable to bundle wires (0.08 to 1.5 mm in diameter) made of a stainless steel, and encase and crimp-weld them in the space in the above-described channel. It is also preferable that the measurement to which the stainless-steel wires stick out of the channel is a brush length of from 10 to 150 mm. It is preferable that the wires encased in the channel be of 0.15 mm stainless steel that is 500 to 650 g. In an implementation where the length of wire is made 80 mm, 550 g is preferable. As to the constituent material of the wire, the wire may be made of a metal such as iron, copper, brass, nickel, or tin.

It should be noted that in spreading on the asphalt, the work is executed at 160 to 230° C. for the application temperature, but asphalt that has cooled during a job sticks to the bristles 101, such that membrane thickness cannot be adequately managed. For that reason, it is advantageous to suitably employ fan heating, a far-infrared heater, or the like to heat the surface of the bristles 101 and make it so that the work may be executed continuously with the asphalt adhering to the bristles.

In a case where the sealing product is 2-mm coated, making applied use of a gauge-3 channel (4 mm thickness) is advantageously suited. In cases where the coating is put on thin, the bristle 101 wires are advantageously made bushy.

Figure 5A:
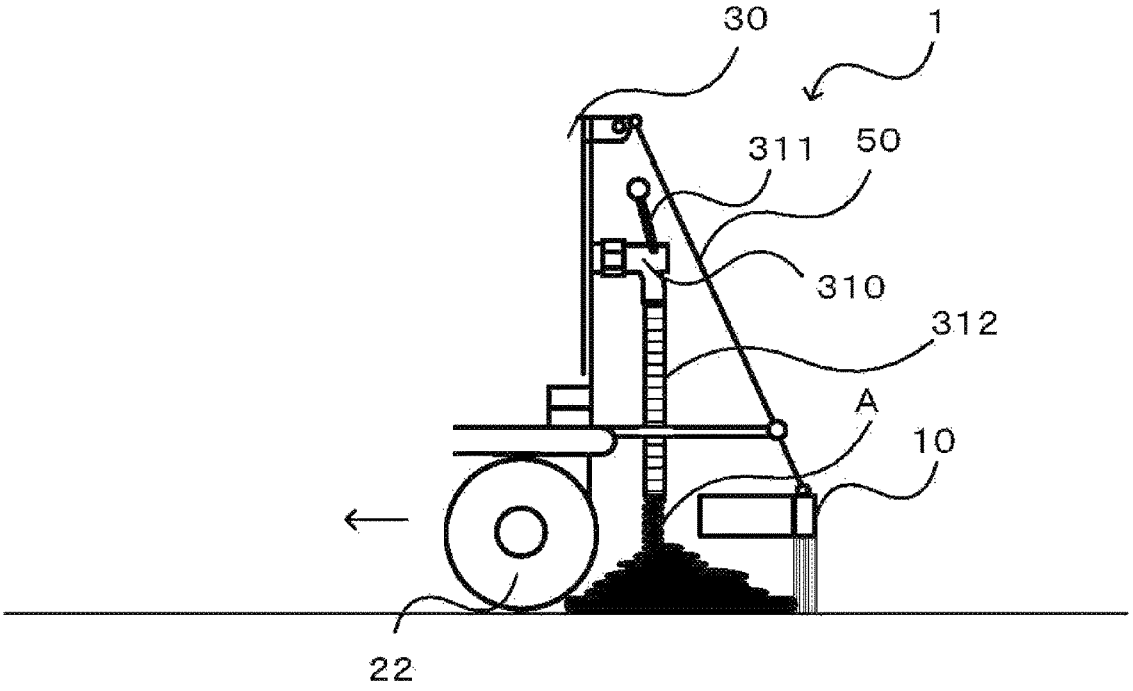
Figure 5B:
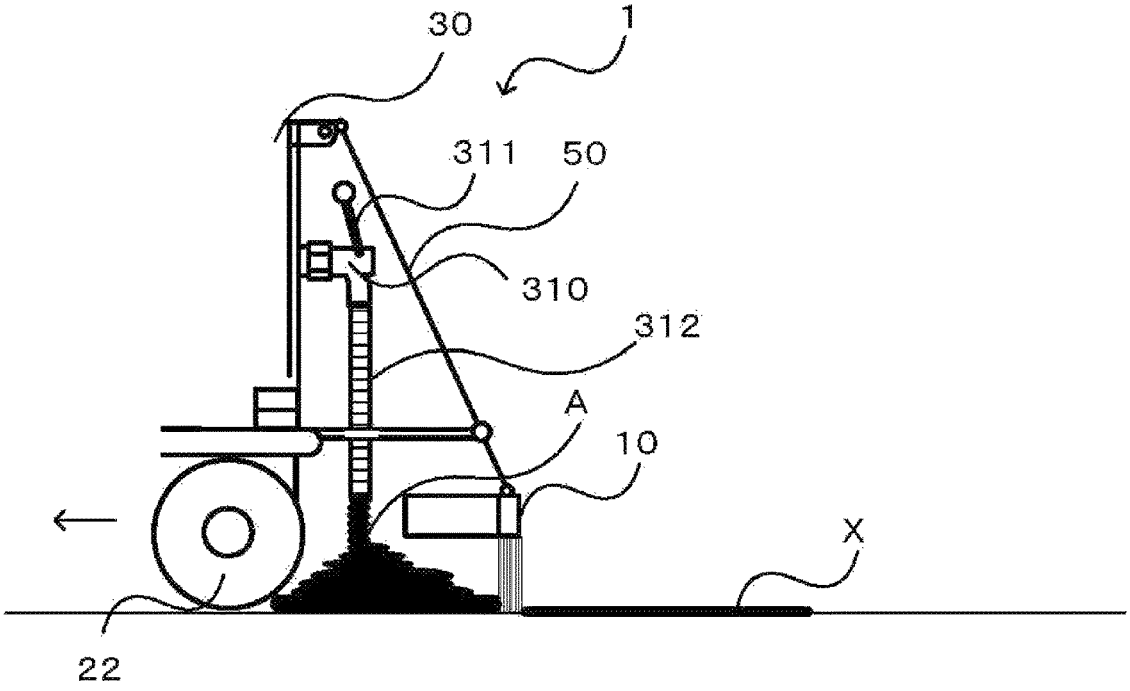

An example of utilizing the deck-slab waterproofing-membrane application apparatus 1 involving Embodiment Example 1 will be described. Reference is made to FIGS. 5A and 5B. FIGS. 5A and 5B are diagrams representing an example of utilizing the deck-slab waterproofing-membrane application apparatus 1 involving Embodiment Example 1, with a portion of the apparatus having been omitted for the sake of explanation.

To begin with, asphalt is put inside the liquefying kettle 31, the propane gas canister P is opened, and the burner is ignited to melt the asphalt. The deck-slab waterproofing-membrane application apparatus 1 is transferred to the site where the job is to be executed and is adjusted to position the application brush 10 over the desired paving line. Then, as indicated in FIG. 5A, the asphalt-discharge port open/close levers 311 are operated to open up the asphalt discharge ports 310 and through the asphalt discharge ports 310, via the flexible stainless-steel hoses 312, drop the melted asphalt A over the desired paving line.

Then, while checking the status of the expelled molten asphalt A and the appearance of the asphalting by application brush 10, the worker draws back the deck-slab waterproofing-membrane application apparatus 1, as indicated in FIG. 5B, to tow the application brush 10 and proceed with the desired paving while the bristles 101 on the application brush 10 level out the molten asphalt A. Once the paving is finished, the asphalt-discharge port open/close levers 311 are operated to shut off the asphalt discharge ports 310 and halt supply of the molten asphalt A.

In this way utilizing a deck-slab waterproofing-membrane application apparatus 1 and application brush 10 involving the present invention enables the applying of deck-slab waterproofing membranes uniformly, safely, and efficiently to highway bridges.

In the foregoing, preferred embodying modes for a deck-slab waterproofing-membrane application brush and deck-slab waterproofing-membrane application apparatus involving the present invention have been illustrated and explained; however, it should be understood that various modifications are possible without departing from the technical scope of the present invention.

Since utilizing a deck-slab waterproofing-membrane application brush and deck-slab waterproofing-membrane application apparatus involving the present invention enables the spreading-on of deck-slab waterproofing membranes uniformly, safely, and efficiently, they may find broad utility in paving not only highway bridges, but general thoroughfares also.

LEGEND

1: deck-slab waterproofing-membrane application apparatus
10: deck-slab waterproofing-membrane application brush
100: furrowed metal plate
101: bristles
20: hand truck
21: rear wheels
22: front wheels
23: handle
30: case
31: liquefying kettle
310: asphalt discharge ports
311: asphalt-discharge port open/close levers
312: flexible stainless-steel hoses
302: upper lid
41: camera
42: monitor
50: towing pieces
P: propane gas canister
A: molten asphalt
T: temperature gauge

What is claimed is:

1. A thoroughfare paving-material application brush for spreading waterproofing product onto highway-bridge deck-slabs, the thoroughfare paving-material application brush comprising:

a metal plate having a furrowed lengthwise edge, the metal plate in overall form being shaped as either a squared-U or a C; and metallic bristles aligned into rows and packed into, and fastened by being clamped by, the furrowed lengthwise edge of the metal plate.

2. A thoroughfare paving-material application brush as set forth in claim 1, wherein the metallic bristles are welded into the metal plate inside the metal plate's furrowed lengthwise edge and fastened therein by lips along the furrowed lengthwise edge being crimped onto the metallic bristles.

3. A thoroughfare paving-material application apparatus comprising:

a hand truck fitted with a handle and enabled for being towed manually by the handle;

a liquefying kettle, carried on board the hand truck, for holding paving material in a liquefied state;

a heating means carried on board the hand truck, for heating the liquefying kettle; and a thoroughfare paving-material application brush as set forth in claim 1, attached front-wise to the hand truck by towing pieces, for applying paving material, heated by the heating means and discharged from the liquefying kettle, onto a thoroughfare surface by the application apparatus being towed to draw the paving-material application brush over the thoroughfare surface.

4. A thoroughfare paving-material application apparatus as set forth in claim 3, further comprising:

a cowl housing the liquifying kettle;

a camera disposed on the cowl in a position enabling the camera to film the status of paving-material application by the paving-material application brush; and a video monitor connected to the camera and disposed on the handle in a position allowing a user towing the application apparatus to monitor the status of paving-material application as filmed by the camera.

5. A thoroughfare paving-material application apparatus as set forth in claim 3, wherein the paving material is a highway deck-slab waterproofing-membrane product.

6. A thoroughfare paving-material application apparatus as set forth in claim 3, wherein the paving material is asphalt.

* * * * *